United States Patent [19]

Cerny

[11] Patent Number: 4,677,764

[45] Date of Patent: Jul. 7, 1987

[54] APPAREL DRYING TRAY

[76] Inventor: Gene L. Cerny, 3850 SW. Gamwell Rd., Topeka, Kans. 66610

[21] Appl. No.: 700,133

[22] Filed: Feb. 11, 1985

[51] Int. Cl.[4] ..... F26B 9/10

[52] U.S. Cl. ..... 34/195; 34/197; 34/202; 34/237; 34/239

[58] Field of Search ..... 34/202, 192, 195, 197, 34/218, 219, 237, 238, 239; 219/400

[56] References Cited

U.S. PATENT DOCUMENTS

| | | | |
|---|---|---|---|
| 1,499,903 | 7/1924 | Beck | 34/233 |
| 1,605,089 | 11/1926 | Bickle et al. | 34/233 |
| 2,184,858 | 12/1939 | Goodman | 34/239 |
| 2,267,158 | 12/1941 | Locke | 34/239 |
| 2,645,863 | 7/1953 | Morrison | 34/239 |
| 2,831,268 | 4/1958 | Cox | 34/151 |
| 2,884,708 | 5/1959 | Levitt | 34/237 |
| 2,893,869 | 7/1975 | Mayer et al. | 134/184 |
| 2,897,973 | 8/1959 | Sizemore | 34/237 |
| 3,007,256 | 11/1961 | Rouy | 34/239 |
| 3,287,820 | 11/1966 | Gibson | 34/239 |
| 3,432,939 | 3/1969 | Eichholz | 34/218 |
| 3,835,552 | 9/1974 | Lord | 34/239 |
| 4,240,211 | 12/1980 | Keever | 34/197 |

FOREIGN PATENT DOCUMENTS

| | | | |
|---|---|---|---|
| 336679 | 10/1930 | United Kingdom | 34/225 |

*Primary Examiner*—Albert J. Makay
*Assistant Examiner*—David W. Westphal

[57] ABSTRACT

A planar drying surface is provided with an overlying water permeable grill for the placement thereon of wet footwear and outerwear. A fan circulates ambient or heated air under and around the wet articles through the grill. The device may be a free standing planar unit or may be positioned within an enclosure. It may also be structurally built into a cavity in a building wall.

2 Claims, 4 Drawing Figures

APPAREL DRYING TRAY

BACKGROUND OF THE INVENTION

This invention relates to a heated tray or enclosure for containing and drying articles of clothing. The designs of contemporary homes do not provide a convenient place or method for drying articles of clothing, shoes, or boots which have become wet and soiled through outdoor use. The entryway of most homes is unheated, and the area adjacent the floor is so cool as to provide virtually no warm airflow to dry these damp articles of clothing. Further, the problem of articles of clothing or shoes which are dripping wet or soiled poses a dilemma to the householder as to where to place these articles so that the soil and water does not stain or discolor the surface on which they are placed.

It is an object of this invention to provide an improved device for drying wet articles of clothing in an energy-efficient manner. It is a further object to provide a safe and convenient appliance for drying wet articles of clothing. A still further object is to provide a low heat output device which slowly dries wet clothing articles.

One embodiment of the invention is to a device for drying clothing articles comprising a planar drying surface, a plurality of heating elements positioned adjacent to and under said planar surface, a means for controlling the energy output of said plurality of heating elements.

Another embodiment of the invention is the drying device detachably fixed within a wall of a building comprising: an enclosure attached to said wall surrounding an opening in said wall to form a passage into the interior of said enclosure, a water permeable planar drying surface positioned in the bottom of the enclosure, a means for heating air positioned within said enclosure, and a means for circulating air through the enclosure.

Still another embodiment is an apparatus for drying clothing articles comprising: a hollow plenum having a first air opening and a second air opening, a permeable, rigid, grill positioned over said first air opening, and a means for generating an air current through said grill positions within said plenum adjacent to said second air opening.

DETAILED DESCRIPTION OF THE INVENTION

Figure 1:
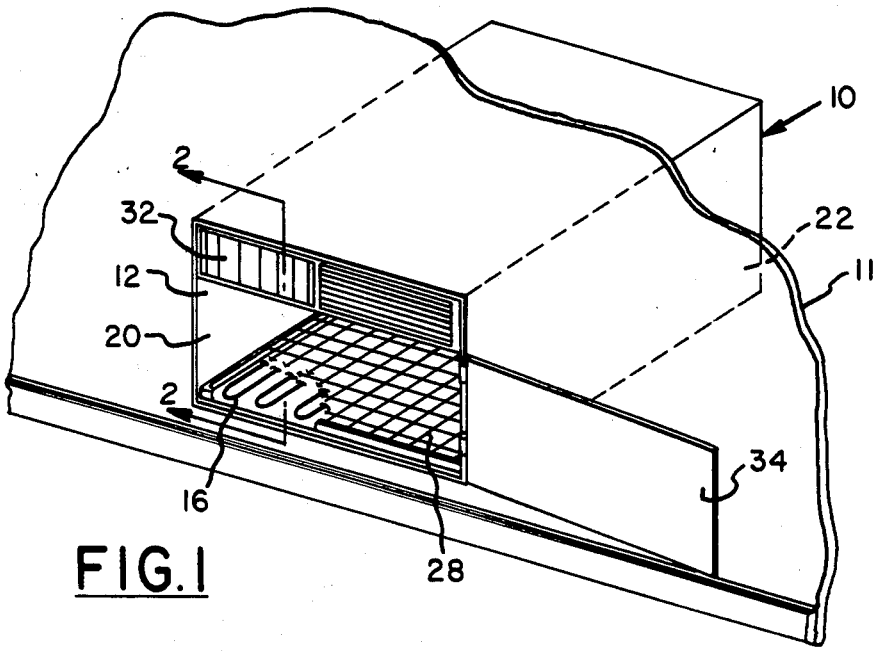
FIG. 1 is a perspective view of an apparel drying device partly in section having resistance heating elements below the planar drying surface.
Figure 2:
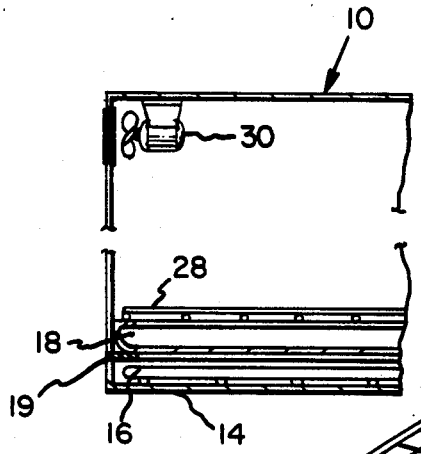
FIG. 2 is a partial section of FIG. 1 taken along line 2—2.

FIGS. 1 and 2 show an apparel drying device composed of an enclosure 10 having an opening 12 in one wall thereof. The enclosure is built into the wall of a building 11. The enclosure has a bottom 14 having a succession of structures layered above it extending into the interior of the enclosure 10. Nearest the bottom 14 is a low temperature heating element 16. A tray 18 is removably mounted above the element 16. One method of removably mounting the tray in the enclosure is by having it slidably positioned on tracks 19 along the walls 20,22. The tray 18 catches any water or debris which drip from the galoshes, boots and other items of apparel. A water permeable, self-supporting grill 28 is positioned above the tray 18 for the purpose of supporting the items of apparel placed thereon. The grill 28 is a rigid, planar structure having a multiplicity of holes. It may be a screen or gridwork of non-corrodable metal, or more preferably, a plastic woven matting. The grill may optionally be hinged on the wall opposite the opening 12 to facilitate removal of the tray 18 through the opening 12 for the purpose of disposing of accumulated water and debris.

An optional fan 30 is shown fixedly attached to the enclosure 10 such that, when activated, directs a stream of circulating air into or out of the enclosure through the opening 12. A portion of the opening 12 adjacent the fan 30 is covered by grillwork or louvers 32 to prevent accidental contact with the fan 30. The make-up air for operation of the fan 30 is provided either through the opening 12 or around the fan through the louvers 32.

The enclosure 10 may optionally include a door 34 covering the opening 12. The door 34 is opened for insertion of the articles of clothing to be dried and closed at other times. If a door 34 is utilized and fan 30 is provided, it is understood that the louvers must be of sufficient area to allow for adequate air circulation through the enclosure.

The apparel drier shown in FIGS. 1 and 2 may be used as a free-standing unit or may be built in as an integral part of a home. Ideally, it is placed in close proximity to the entryway of the home to accommodate the shoes, boots and other apparel which have become wet from inclement weather.

The enclosure may be preferably molded from plastic, or fabricated from wood or metal. It is understood that in the construction of a home, the enclosure 10 may be fabricated as an integral part of the structure and the component parts of this invention positioned within that fabricated enclosure.

Figure 3:
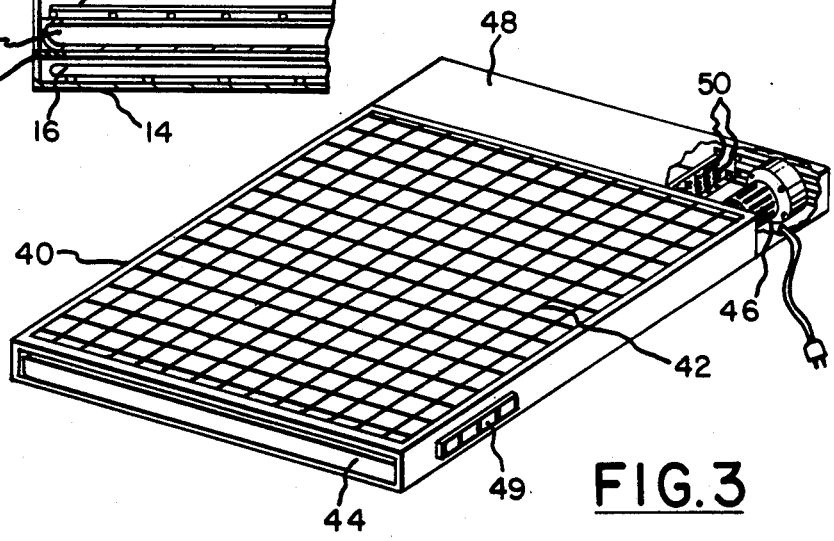
FIG. 3 is a compact embodiment of the invention featuring a unitary fan and heater assembly adjacent to the grill drying surface.

FIG. 3 illustrates a compact embodiment of the invention. The frame 40 has a top surface consisting in major portion of a water permeable grill 42 with a tray 44 positioned directly beneath the grill 42. The tray 44 is slidably and removably positioned within the frame 40. A fan 46 is fixedly attached to the frame 40 adjacent louvers 47 and adjacent one edge of the grill 42. The fan 46 is enclosed by a plenum 48 which directs the airflow of the fan 46 generally in a direction parallel to the plane of the grill 42. The airflow from the fan courses upward through the grill to effect drying of any articles of apparel placed on the grill. The unit may optionally include meansfor heating the air such as heating elements 50 through which the airflow is directed to raise the air temperature above ambient temperature. A switch 49 is shown attached to frame 40 for controlling the operation of the fan 46 and heating element 50.

The compact embodiment shown in FIG. 3 is adaptable for use in an enclosure similar to the one shown in FIG. 1. Of course, the fan 30 of FIG. 1 would be unnecessary since the airflow function is built into the unit of FIG. 3. The unit of FIG. 3 would be positioned to form the bottom surface of the enclosure 10.

Figure 4:
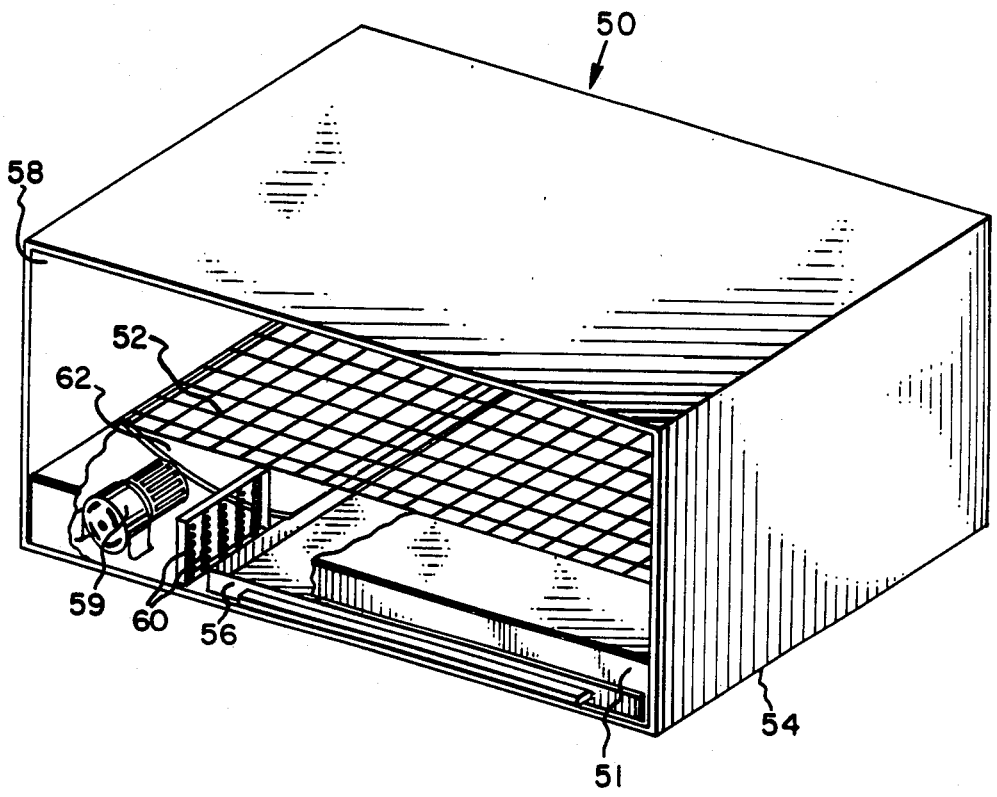
FIG. 4 is another embodiment of the invention in an enclosure.

FIG. 4 shows another embodiment of the invention in which an enclosure 50 includes as its lower portion a plenum 51. The plenum distributes air evenly throughout the enclosure 50. A grill 52 forms a major portion of the top surface of the plenum 51. A drip tray 56 is slidably and removably positioned between the grill 52 and the bottom of the plenum 54 to catch water dripping from articles placed on top of the grill 52. The portion of the plenum 51 adjacent the open ends of the enclosure 50 contains a means for generating an airflow from outside the enclosure to the inside. A fan 59 is shown fixed in the plenum adjacent the open end 58, adapted to draw air from outside and blow the air through a plurality of heating elements 60 and into the plenum 51 for distribution up through the grill 52 into the enclosure and then out through the upper portion of the open end 58. This heated air current serves to gently dry any clothing articles placed in the enclosure.

A secondary drip pan 62 drains water from the grill 52 into the removable drip tray 56, thus preventing any water from accumulating within the enclosure. The drip tray 56 may be removed and the accumulated water discarded as required during use.

I claim:

1. A device for drying articles of clothing comprising:

a low profile rigid frame of substantially lesser height dimension than width and length dimensions and divided into a larger section having an open top and a laterally adjacent smaller section with an interface between said larger section and smaller section; a plenum positioned along said smaller section and laterally adjacent to the larger section, discharging along a majority of the interface and being adapted to direct air flow into the laterally adjacent larger section in a direction parallel to the plane of the open top of said larger section; a water permeable horizontal rigid grill covering said open top of said larger section for direct placement thereon of said articles of clothing; a drip tray horizontally positioned under and coplanar with said grill for catching water that passes through said grill; louvers opening through said frame into said plenum; a fan attached to said frame within said plenum adapted for drawing air through said louvers and over said plurality of heating elements and discharging said air from said plenum along a plane parallel to the grill and from an edge of the grill directly adjacent said plenum.

2. An apparatus according to claim 1 further comprising an enclosure of rigid self-supporting walls having one open side, a larger upper section and a smaller lower section; said frame being fixedly positioned in said smaller lower section such that said louvers are positioned on said open side and said tray can be slidably removed through said one open side.

* * * * *